US009874066B2

(12) United States Patent
Corre et al.

(10) Patent No.: US 9,874,066 B2
(45) Date of Patent: Jan. 23, 2018

(54) PACKER ASSEMBLY WITH SEALING BODIES

(75) Inventors: Pierre-Yves Corre, Eu (FR); Jean-Louis Pessin, Amiens (FR); Stephane Metayer, Abbeville (FR); Stephen Yeldell, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 931 days.

(21) Appl. No.: 13/994,636

(22) PCT Filed: Dec. 16, 2011

(86) PCT No.: PCT/US2011/065516
§ 371 (c)(1),
(2), (4) Date: Sep. 24, 2013

(87) PCT Pub. No.: WO2012/083180
PCT Pub. Date: Jun. 21, 2012

(65) Prior Publication Data

US 2014/0008061 A1 Jan. 9, 2014

Related U.S. Application Data

(60) Provisional application No. 61/423,905, filed on Dec. 16, 2010.

(51) Int. Cl.
*E21B 49/08* (2006.01)
*E21B 49/10* (2006.01)
(Continued)

(52) U.S. Cl.
CPC ..... *E21B 33/12* (2013.01); *E21B 33/1208* (2013.01); *E21B 33/1243* (2013.01);
(Continued)

(58) Field of Classification Search
CPC ..... E21B 33/12; E21B 33/127; E21B 23/00; E21B 43/10
(Continued)

(56) References Cited

U.S. PATENT DOCUMENTS 2,600,173 A 6/1952 Sewell et al.
2,843,208 A 7/1958 Blood
(Continued)

OTHER PUBLICATIONS

International Search Report for International Application No. PCT/US2011/065516 dated Aug. 31, 2012.

*Primary Examiner* — David Bagnell
*Assistant Examiner* — Manuel C Portocarrero
(74) *Attorney, Agent, or Firm* — Michael Dae

(57) ABSTRACT

A packer assembly has an inner expandable packer. An outer layer having sealing bodies may be disposed about and/or positioned on the outer surface of the inner expandable packer member. Each of the sealing bodies may have an elastomeric body, and one or more flowlines may be embedded in the elastomeric body of each of the sealing bodies. The sealing bodies may be located in grooves in the inner expendable packer member. The sealing bodies may contact a surrounding casing or a surrounding formation to form an annular seal; in an embodiment, the sealing bodies and the inner expandable packer member may contact a surrounding casing or a surrounding formation to form an annular seal. The sealing bodies may be non-integral with each other and/or separable from each other.

19 Claims, 7 Drawing Sheets

(51) Int. Cl.
*E21B 33/124* (2006.01)
*E21B 33/12* (2006.01)
*E21B 33/127* (2006.01)

(52) U.S. Cl.
CPC ..... *E21B 33/1277* (2013.01); *E21B 49/084* (2013.01); *E21B 49/10* (2013.01)

(58) Field of Classification Search
USPC ..... 166/187, 100
See application file for complete search history.

(56) References Cited

U.S. PATENT DOCUMENTS

| | | | | |
|---|---|---|---|---|
| 6,769,484 | B2 * | 8/2004 | Longmore | E21B 43/082 166/207 |
| 7,699,124 | B2 | 4/2010 | Corre et al. | |
| 8,113,293 | B2 * | 2/2012 | Corre | E21B 33/1243 166/145 |
| 2007/0215348 | A1 | 9/2007 | Corre et al. | |
| 2009/0038390 | A1 * | 2/2009 | Dahan | G01N 33/246 73/152.24 |
| 2009/0301715 | A1 * | 12/2009 | Corre | E21B 49/10 166/250.17 |

* cited by examiner

PACKER ASSEMBLY WITH SEALING BODIES

This application claims the benefit of U.S. Provisional Application Ser. No. 61/423,905 entitled "Packer Assembly With Flowline Assemblies" filed Dec. 16, 2010, which is hereby incorporated by reference in its entirety.

BACKGROUND

Hydrocarbons, such as oil and natural gas, are obtained from a subterranean geologic formation by drilling a wellbore that penetrates the hydrocarbon-bearing formation. After a wellbore has been drilled, the wellbore may be "completed" before hydrocarbons are obtained. A sealing system, such as a packer, may be deployed in a wellbore as completion equipment.

A packer is a device having an initial outside diameter which is smaller than a wellbore in which the packer is implemented. The packer is positioned at a desired location within the wellbore. Then, a sealing element of the packer is expanded to create an increased outside diameter which forms an annular seal between the packer and a surrounding outer surface, such as a casing string or a wall of the wellbore.

The annular seal isolates the wellbore sections above the packer from the wellbore sections below the packer and may provide a mechanical anchor which prevents the packer from sliding inside the wellbore. Alternatively or additionally, the packer may have slips which are components which engage the surrounding outer surface to anchor the packer in position. Mechanically anchoring the packer is known as "setting" the packer.

A packer may be set in a cased wellbore or an uncased wellbore. The annular seal formed by the packer may be used to control production, injection or treatment. After a particular operation is complete, the sealing element and/or the slips may be retracted to enable the packer to be removed or moved to another location in the wellbore.

It remains desirable to provide improvements in packers and methods of setting packers.

DETAILED DESCRIPTION

The present disclosure generally relates to a packer assembly having an inner expandable packer. An outer layer having sealing bodies may be disposed about and/or positioned on the outer surface of the inner expandable packer member. The sealing bodies may or may not be fixedly attached to the inner expandable packer member. Each of the sealing bodies may have an elastomeric body, and one or more flowlines may be positioned in the elastomeric body of each of the sealing bodies. The flowlines may be connected to a downstream component, such as a fluid analysis module, a fluid containment module and/or the like.

The sealing bodies may be located in grooves in the inner expendable packer member. The sealing bodies may contact a surrounding casing or a surrounding formation to form an annular seal; in an embodiment, the sealing bodies and the inner expandable packer member may contact a surrounding casing or a surrounding formation to form an annular seal. The packer assembly may be deployed on a wireline cable and/or other suitable deployment or conveyance.

Figure 1:
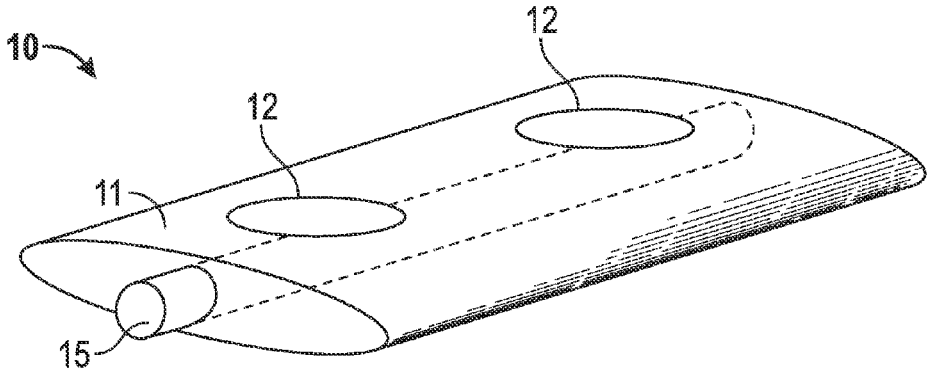
FIGS. 1, 2, 3 and 9 illustrate examples of sealing bodies which may be implemented in embodiments of a packer assembly in accordance with one or more aspects of the present disclosure.

FIG. 1 generally illustrates an embodiment of a sealing body 10 which may have an elastomeric body 11. The elastomeric body 11 may have one or more ports 12 and may have a flowline 15. The elastomeric body 11 may have any shape; in an embodiment, the elastomeric body 11 may have an oval cross-section. The flowline 15 may be a tube and may be positioned in the elastomeric body 11. In an embodiment, the flowline 15 may be made of metal and/or plastic and may be embedded in the elastomeric body 11. However, the flowline 15 may be made of any material, and the flowline 15 is not limited to a specific material. In an embodiment, the one or more ports 12 may be sampling ports, and the flowline 15 may be a sampling flowline which receives and conveys fluid obtained by the sampling ports.

Figure 2:
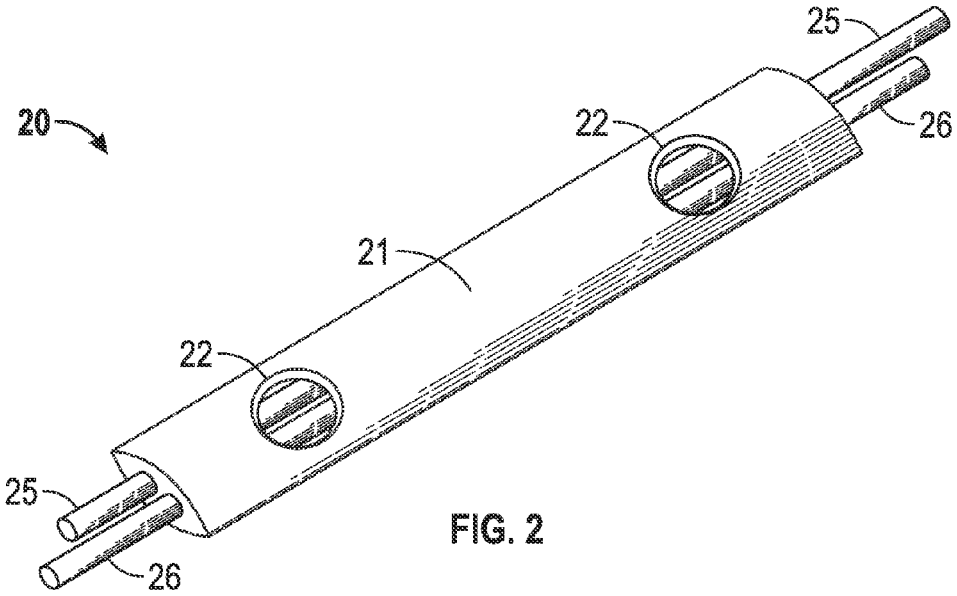

FIG. 2 generally illustrates an embodiment of a sealing body 20 which may have an elastomeric body 21. The elastomeric body 21 may have one or more ports 22, a sampling flowline 25, and/or a guard flowline 26. The elastomeric body 21 may have any shape; in an embodiment, the elastomeric body 21 may have an oval cross-section. Each of the sampling flowline 25 and the guard flowline 26 may be a tube and may be positioned in the elastomeric body 21. In an embodiment, each of the sampling flowline 25 and the guard flowline 26 may be made of metal and/or plastic and may be embedded in the elastomeric body 21. However, the sampling flowline 25 and the guard flowline 26 may be made of any material, and the sampling flowline 25 and the guard flowline 26 are not limited to a specific material. The sampling flowline 25 may receive and may convey fluid which enters a sampling port, and the guard flowline 26 may receive and may convey fluid which enters a guard port.

Figure 3:
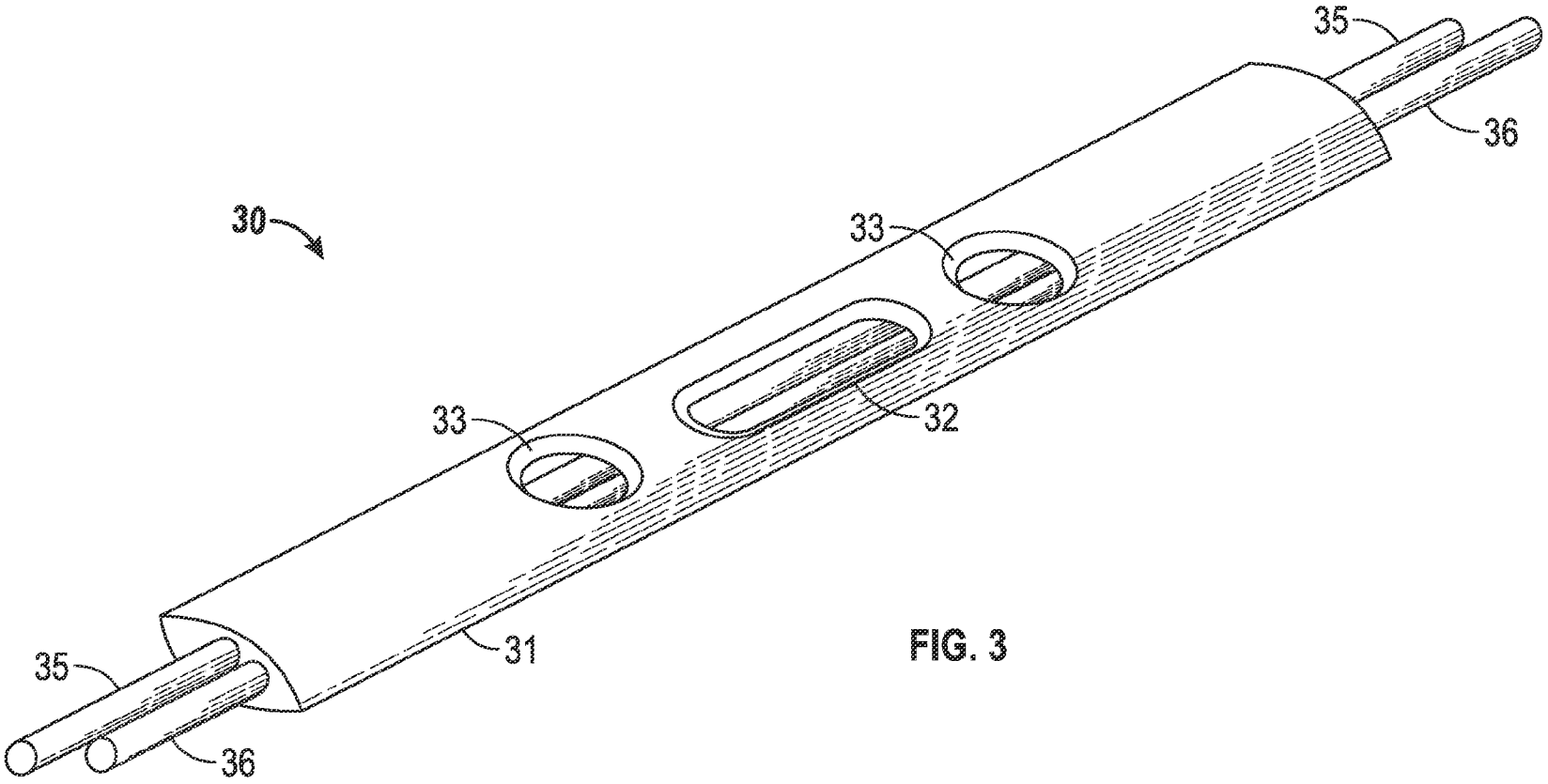

FIG. 3 generally illustrates an embodiment of a sealing body 30 which may have an elastomeric body 31. The elastomeric body 31 may have a sampling port 32, a sampling flowline 35 which receives and conveys fluid which enters the sampling port 32, one or more guard ports 33, and/or a guard flowline 36 which receives and conveys fluid which enters the one or more guard ports 33. The elastomeric body 31 may have any shape; in an embodiment, the elastomeric body 31 may have an oval cross-section. In an embodiment, the sampling port 32 may have an lateral width substantially similar to the lateral width of the sealing body 30; however, the sampling port 32 may have any lateral width, and the sealing body 30 is not limited to a specific lateral width of the sampling port 32.

Each of the sampling flowline 35 and the guard flowline 36 may be a tube and may be positioned in the elastomeric body 31. In an embodiment, each of the sampling flowline 35 and the guard flowline 36 may be made of metal and/or plastic and may be embedded in the elastomeric body 31. However, the sampling flowline 35 and the guard flowline 36 may be made of any material, and the sampling flowline 25 and the guard flowline 26 are not limited to a specific material.

The sampling flowline 35 may be connected to sampling ports located upstream and/or sampling ports located downstream from the sampling port 32. The guard flowline 36 may be connected to guard ports located upstream and/or guard ports located downstream from the guard port 33. In an embodiment, the sampling port 32 may have an area larger than the area of each of the one or more guard ports 33; however, the sampling port 32 and the one or more guard ports 33 may have any area and may have any relative area with respect to each other.

The one or more guard ports 33 may be located adjacent to the sampling port 32. In an embodiment, the one or more guard ports 33 may include two guard ports, and the two guard ports may be located on opposite axial sides of the sampling port 32 as generally shown in FIG. 3. The one or more guard ports 33 are not limited to a specific location relative to the sampling port 32 or a specific number of guard ports.

Figure 4:
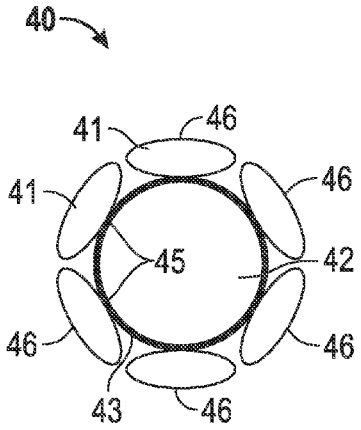
FIGS. 4, 5, 6, 7, 8, 10 and 11 illustrate examples of embodiments of a packer assembly in accordance with one or more aspects of the present disclosure.
Figure 5:
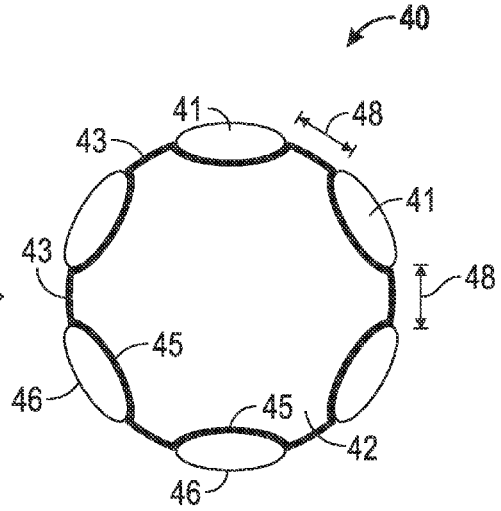

FIGS. 4 and 5 generally illustrate an embodiment of a packer assembly 40 which may have sealing bodies 41 disposed about and/or positioned on an outer surface 43 of an inner packer member 42. FIG. 4 generally illustrates the packer assembly 40 in a retracted position, such as, for example, an uninflated position, and FIG. 5 generally illustrates the packer assembly 40 in an expanded position, such as, for example, an inflated position. The packer assembly 40 may be moved from the retracted position to the expanded position by pumping a fluid into the inner packer member 42; by applying mechanical force to the inner packer member 42, such as compression or tension; by applying hydraulic pressure to the inner packer member 42; and/or the like. For example, an embodiment of the inner packer member 42 may be and/or may have an inflatable bladder that radially expands upon receipt of a predetermined amount of fluid. Any means known to one having ordinary skill in the art may be used to move the packer assembly 40 from the retracted position to the expanded position, and the packer assembly 40 is not limited to a specific means for moving the packer assembly 40 from the retracted position to the expanded position.

Each of the sealing bodies 41 may be the sealing body 10, the sealing body 20, the sealing body 30 or another type of sealing body. FIGS. 4 and 5 depict six of the sealing bodies 41, but the packer assembly 40 may have any number of the sealing bodies 41.

The sealing bodies 41 may be non-integral with each other and/or separable from each other. The sealing bodies 41 may have inner surfaces 45 and outer surfaces 46 relative to the inner packer member 42. The outer surfaces 46 of the sealing bodies 41 may be continuous with each other when the packer assembly 40 is in the retracted position. When the inner packer member 42 moves from the retracted position to the expanded position, the outer surface 43 of the inner packer member 42 may move the sealing bodies 41 outward in a radial direction. The sealing bodies 41 may be displaced relative to each other, and gaps 48 of radial distance may be formed between the sealing bodies 41. In the expanded position, the inner packer member 42 may at least partially fill the gaps 48.

The outer surfaces 46 of the sealing bodies 41 and the outer surface 43 of the inner packer member 42 may contact a surrounding surface, such as a casing string or a wall of the wellbore, to form an annular seal. Formation fluid may be withdrawn into a sampling port and/or a guard port of one or more of the sealing bodies 41. In an embodiment, one of the sealing bodies 41 may have a sampling port that is radially unaligned with a first sampling port and/or a second sampling port of another one of the sealing bodies 41, such as an adjacent one of the sealing bodies 41. In an embodiment, the sampling port of one of the sealing bodies 41 may receive less mud contaminants than the sampling port of another one of the sealing bodies 41.

Each of the sealing bodies 41 may be replaced without replacing the inner packer member 42 or replacing the other sealing bodies 41. For example, one of the sealing bodies 41 may be removed from the packer assembly 40 without removing the other sealing bodies 41 from the packer assembly 40, and a new sealing body 41 may be positioned in the packer assembly 40. Replacement of one of the sealing bodies 41 may enable a change in the number of guard ports, the size of guard ports, the location of guard ports within the sealing body 41, the number of sampling ports, the size of sampling ports, and the location of sampling ports within the sealing body 41.

Figure 6:
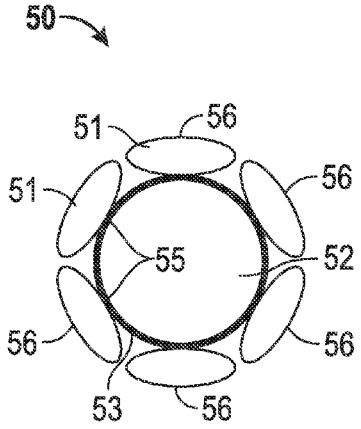
Figure 7:
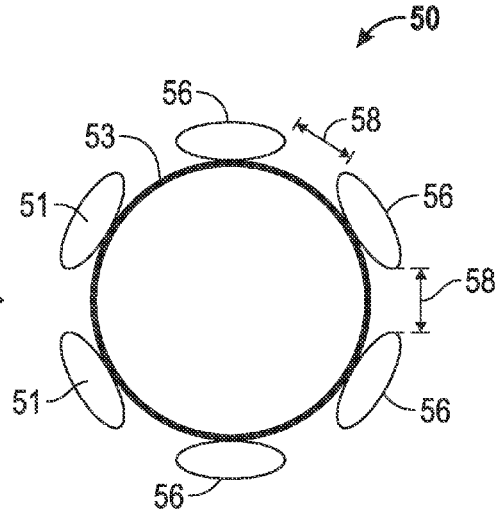

FIGS. 6 and 7 generally illustrate an embodiment of a packer assembly 50 which may have sealing bodies 51 disposed about and/or connected to an outer surface 53 of an inner packer member 52. FIG. 6 generally illustrates the packer assembly 50 in a retracted position, such as, for example, an uninflated position, and FIG. 7 generally illustrates the packer assembly 50 in an expanded position, such as, for example, an inflated position. The packer assembly 50 may be moved from the retracted position to the expanded position by pumping a fluid into the inner packer member 52; by applying mechanical force to the inner packer member 52, such as compression or tension; by applying hydraulic pressure to the inner packer member 52; and/or the like. For example, an embodiment of the inner packer member 42 may be and/or may have an inflatable bladder that radially expands upon receipt of a predetermined amount of fluid. Any means known to one having ordinary skill in the art may be used to move the packer assembly 50 from the retracted position to the expanded position, and the packer assembly 50 is not limited to a specific means for moving the packer assembly 50 from the retracted position to the expanded position.

Each of the sealing bodies 51 may be the sealing body 10, the sealing body 20, the sealing body 30 or another type of sealing body. FIGS. 6 and 7 depict six of the sealing bodies 51, but the packer assembly 50 may have any number of the sealing bodies 51.

The sealing bodies 51 may be non-integral with each other and/or separable from each other. The sealing bodies 51 may have inner surfaces 55 and outer surfaces 56 relative to the inner packer member 52. The outer surfaces 56 of the sealing bodies 51 may be continuous with each other when the packer assembly 50 is in the retracted position. When the inner packer member 52 moves from the retracted position to the expanded position, the outer surface 53 of the inner packer member 52 may move the sealing bodies 51 outward in a radial direction. The sealing bodies 51 may be displaced relative to each other, and gaps 58 of radial distance may be formed between the sealing bodies 51. In the expanded position, the inner packer member 52 may partially fill the gaps 58. The outer surface of the packer assembly 50 may be substantially not continuous.

The outer surfaces 56 of the sealing bodies 51 may contact a surrounding surface, such as a casing string or a wall of the wellbore, to form an annular seal. Formation fluid may be withdrawn into a sampling port and a guard port of one or more of the sealing bodies 51. In an embodiment, one of the sealing bodies 41 may have a sampling port that is radially unaligned with a first sampling port and/or a second sampling port of another one of the sealing bodies 41, such as an adjacent one of the sealing bodies 41. In an embodiment, the sampling port of one of the sealing bodies 51 may receive less mud contaminants than the sampling port of another one of the sealing bodies 51.

Each of the sealing bodies 51 may be replaced without replacing the inner packer member 52 or replacing the other sealing bodies 51. For example, one of the sealing bodies 51 may be removed from the packer assembly 50 without removing the other sealing bodies 41 from the packer assembly 50, and a new sealing body 51 may be positioned in the packer assembly 50. Replacement of one of the sealing bodies 51 may enable a change in the number of guard ports, the size of guard ports, the location of guard ports within the sealing body 51, the number of sampling ports, the size of sampling ports, and the location of sampling ports within the sealing body 51.

Figure 8:
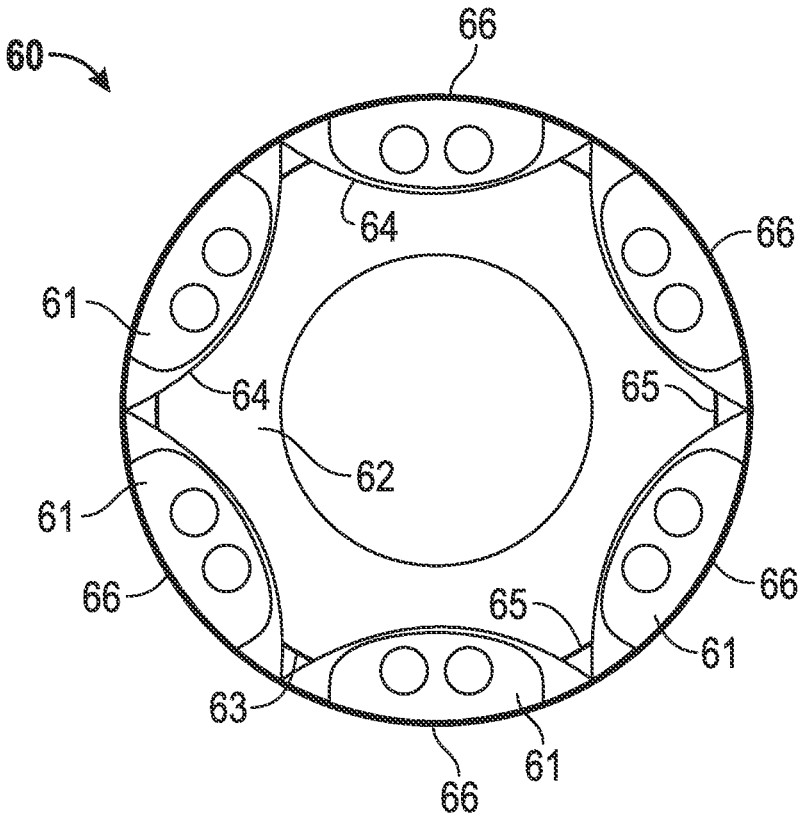

FIG. 8 generally illustrates an embodiment of a packer assembly 60 which may have sealing bodies 61 which may reside in grooves 64 in an outer surface 63 of an inner packer member 62. The packer assembly 60 may be moved from a retracted position to an expanded position by pumping a fluid into the inner packer member 62; by applying mechanical force to the inner packer member 62, such as compression or tension; by applying hydraulic pressure to the inner packer member 62; and/or the like. For example, an embodiment of the inner packer member 62 may be and/or may have an inflatable bladder that radially expands upon receipt of a predetermined amount of fluid. Any means known to one having ordinary skill in the art may be used to move the packer assembly 60 from the retracted position to the expanded position, and the packer assembly 60 is not limited to a specific means for moving the packer assembly 60 from the retracted position to the expanded position.

Figure 9:
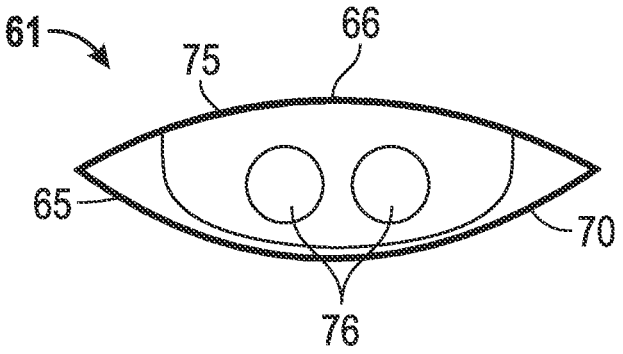

Each of the sealing bodies 61 may be the sealing body 10, the sealing body 20, the sealing body 30 or another type of sealing body. FIG. 9 depicts six of the sealing bodies 61, but the packer assembly 60 may have any number of sealing bodies.

The sealing bodies 61 may be non-integral with each other and/or separable from each other. The sealing bodies 61 may have inner surfaces 65 and outer surfaces 66 relative to the inner packer member 62. When the inner packer member 62 moves from the retracted position to the expanded position, the grooves 64 may move each of the sealing bodies 61 outward in a radial direction. The sealing bodies 61 may act as a continuous layer despite being separate non-integral components of the packer assembly 60.

In the expanded position, the outer surfaces 66 of the sealing bodies 61 may contact a surrounding surface, such as a casing string or a wall of the wellbore, to form an annular seal. Formation fluid may be withdrawn into a sampling port and a guard port of one or more of the sealing bodies 61. In an embodiment, one of the sealing bodies 41 may have a sampling port that is radially unaligned with a first sampling port and/or a second sampling port of another one of the sealing bodies 41, such as an adjacent one of the sealing bodies 41. In an embodiment, the sampling port of one of the sealing bodies 61 may receive less mud contaminants than the sampling port of another one of the sealing bodies 61.

Each of the sealing bodies 61 may be replaced without replacing the inner packer member 62 or replacing the other sealing bodies 61. For example, one of the sealing bodies 61 may be removed from the packer assembly 60 without removing the other sealing bodies 61 from the packer assembly 60, and a new sealing body 61 may be positioned in the packer assembly 60. Replacement of one of the sealing bodies 61 may enable a change in the number of guard ports, the size of guard ports, the location of guard ports within the sealing body 61, the number of sampling ports, the size of sampling ports, and the location of sampling ports within the sealing body 61.

The sealing bodies 61 may not be fixedly attached to the inner packer member 62. The sealing bodies 61 may move relative to and/or may detach from the inner packer member 62. As generally illustrated in FIG. 9, a release agent 70 may reversibly attach one or more of the sealing bodies 61 to the inner packer member 62. For example, the release agent 70 may be located on the inner surfaces 65 of the sealing bodies 61 and/or on the outer surface 63 of the inner packer member 62. The release agent 70 may prevent adhesion of the inner surfaces 65 of the sealing bodies 61 to the outer surface 63 of the inner packer member 62 and/or may enable the sealing bodies 61 to detach from the inner packer member 62.

The release agent 70 may be formed from a non-compatible expandable material such as, for example, silicon, crude PTFE, and/or the like, and/or a non-expandable material, such as, for example, metallic material, a thermoplastic layer, and/or the like. The release agent 70 is not limited to a specific embodiment of the material, and the release agent 70 may be any release agent known to one having ordinary skill in the art.

One or more of the sealing bodies 61 may have an elastomeric body 75, such as the elastomeric body 11, the elastomeric body 21, the elastomeric body 31 or another type of elastomeric body. One or more flowlines 76 may be positioned in and/or embedded in the elastomeric body 75. The elastomeric body 75 may be formed from an elastomeric material that is not chemically compatible with the elastomeric material of the inner packer member, such as the inner packer member 52, the inner packer member 62, the inner packer member 72 or another type of inner packer member. For example, the elastomeric body 75 may be formed from fluorinated rubber, such as FKM, a fluoroelastomer containing vinylidene fluoride; FFKM, a perfluoroelastomer; Aflas (registered trademark of Asahi Glass Company), a fluoroelastomer based upon an alternating copolymer of tetrafluoroethylene and propylene; and/or the like. the elastomeric body 75 may be embedded with a high temperature thermoplastic material, such as Polytetrafluoroethylene, polyether ether ketone ("PEEK") and/or the like. For example, portions of the elastomeric body adjacent to the flowlines may be a high temperature thermoplastic material. The elastomeric body 75 is not limited to a specific material.

Figure 10:
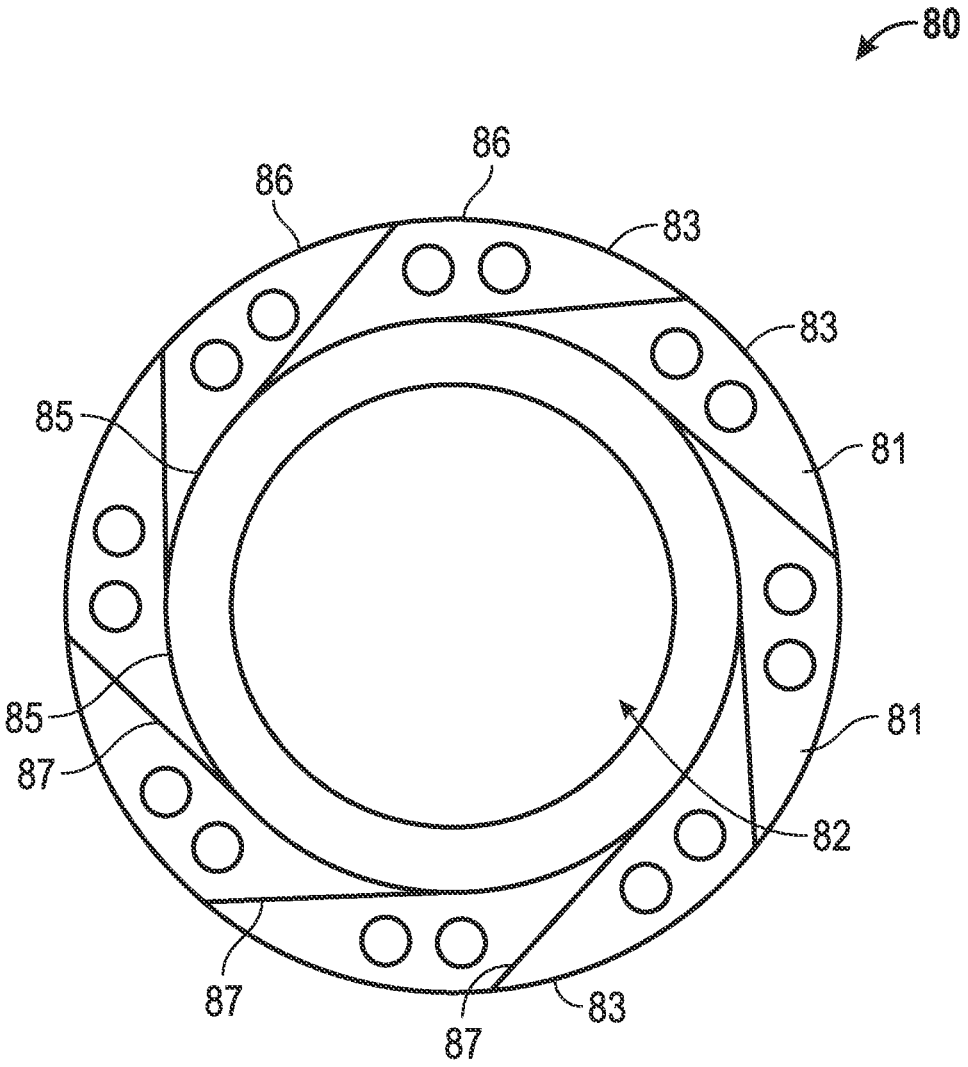
Figure 11:
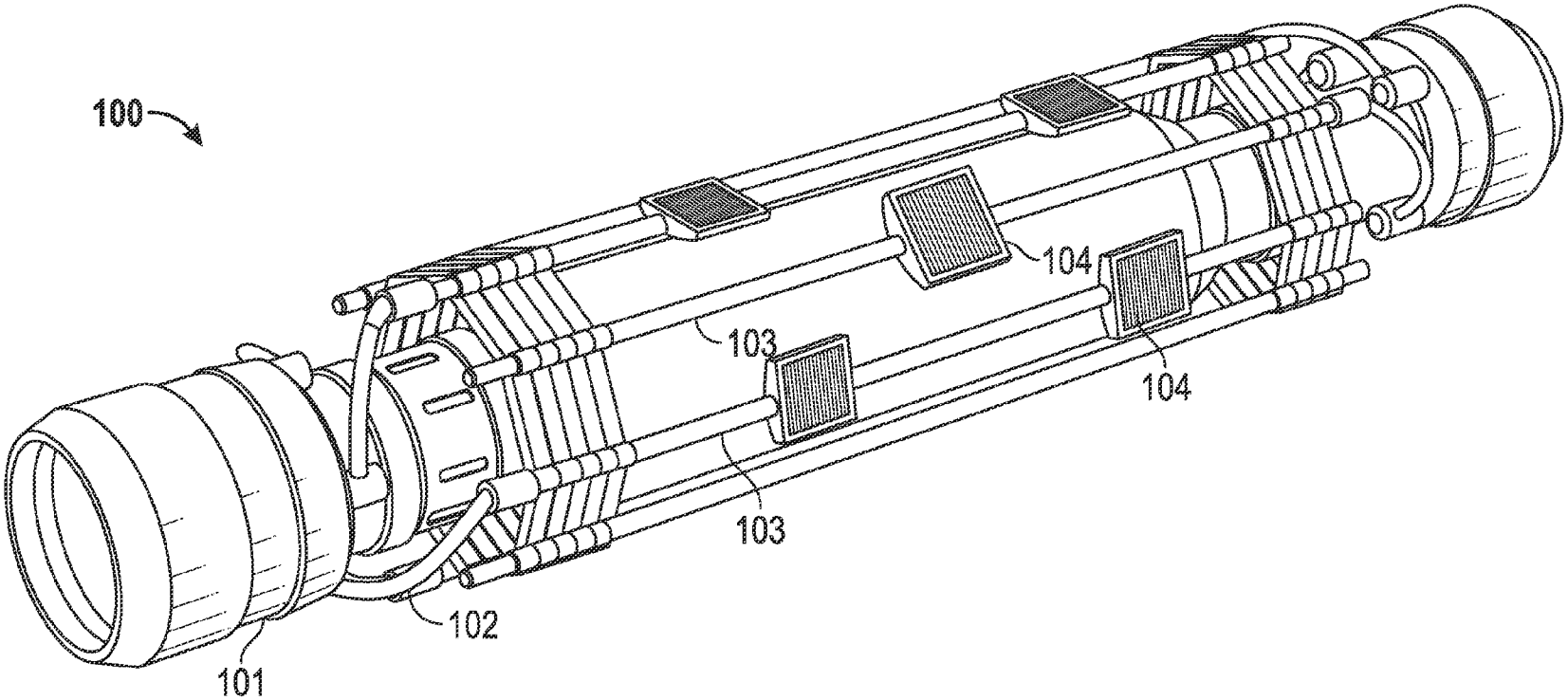

FIG. 10 generally illustrates an embodiment of a packer assembly 80 which may have sealing bodies 81 disposed about an outer surface 83 of an inner packer member 82. FIG. 11 generally illustrates the packer assembly 80 in a retracted position, such as, for example, an uninflated position. The packer assembly 80 may be moved from the retracted position to an expanded position by pumping a fluid into the inner packer member 82; by applying mechanical force to the inner packer member 82, such as compression or tension; by applying hydraulic pressure to the inner packer member 82; and/or the like. For example, an embodiment of the inner packer member 82 may be and/or may have an inflatable bladder that radially expands upon receipt of a predetermined amount of fluid. Any means known to one having ordinary skill in the art may be used to move the packer assembly 80 from the retracted position to the expanded position, and the packer assembly 80 is not limited to a specific means for moving the packer assembly 80 from the retracted position to the expanded position.

Each of the sealing bodies 81 may be the sealing body 10, the sealing body 20, the sealing body 30 or another type of sealing body. FIG. 11 depicts eight of the sealing bodies 81, but the packer assembly 80 may have any number of the sealing bodies 81.

The sealing bodies 81 may be non-integral with each other and/or separable from each other. The sealing bodies 81 may have inner surfaces 85, outer surfaces 86 and side surfaces 87 relative to the inner packer member 82. The outer surfaces 86 of the sealing bodies 81 may be continuous with each other when the packer assembly 80 is in the retracted position. The sealing bodies 81 may overlap. More specifically, the side surfaces 87 may be angled relative to the inner surfaces 85 and/or the outer surfaces 86, and two or more of the sealing bodies 81 may axially overlap each other relative to the inner packer member 82.

For each of the sealing bodies 81, one of the side surfaces 87 may be in contact with one of the side surfaces 87 of an adjacent one of the sealing bodies 81 when the packer assembly 80 is in the retracted position. The other one of the side surfaces 87 may be in contact with one of the side surfaces 87 of the other adjacent one of the sealing bodies 81 when the packer assembly 80 is in the retracted position. In an embodiment, each of the sealing bodies 81 may radially overlap one or more of the other sealing bodies 81.

When the inner packer member 82 moves from the retracted position to the expanded position, gaps of radial distance may be formed between the outer surfaces 86 of the sealing bodies 51, and at least a portion of each of the side surfaces 87 may remain in contact with the side surfaces 87 of each of the adjacent sealing bodies. For example, the sealing bodies 81 may have a first side surface which may contact a side surface of an adjacent one of the sealing bodies 81. The flow assemblies 81 may have a second side surface opposite to the first side surface, and the second side surface may contact a side surface of the other adjacent one of the sealing bodies 81.

When the inner packer member 82 is in the expanded position, two or more of the sealing bodies 81 may radially overlap each other relative to the inner packer member 82. In an embodiment, each of the sealing bodies 81 may radially overlap one or more of the other sealing bodies 81 when the inner packer member 82 is in the expanded position. The outer surfaces 86 of the sealing bodies 81 may contact a surrounding surface, such as a casing string or a wall of the wellbore, to form an annular seal. Formation fluid may be withdrawn into a sampling port and a guard port of one or more of the sealing bodies 81. In an embodiment, one of the sealing bodies 41 may have a sampling port that is radially unaligned with a first sampling port and/or a second sampling port of another one of the sealing bodies 41, such as an adjacent one of the sealing bodies 41. In an embodiment, the sampling port of one of the sealing bodies 81 may receive less mud contaminants than the sampling port of another one of the sealing bodies 81.

The sealing bodies 81 may remain at least partially overlapped and/or in contact with each other in the expanded position of the packer assembly 80. Such positioning of the sealing bodies 81 may form an anti-extrusion layer for the packer assembly 80 and may be implemented when setting the packer assembly 80 in a wellbore and/or a casing, such as a perforated casing, for example. The packer assembly 80 may be implemented in any environment, and the packer assembly 80 is not limited to a specific environment of use.

Each of the sealing bodies 81 may be replaced without replacing the inner packer member 82 or replacing the other sealing bodies 81. For example, one of the sealing bodies 81 may be removed from the packer assembly 80 without removing the other sealing bodies 81 from the packer assembly 80, and a new sealing body 81 may be positioned in the packer assembly 80. Replacement of one of the sealing bodies 81 may enable a change in the number of guard ports, the size of guard ports, the location of guard ports within the sealing body 81, the number of sampling ports, the size of sampling ports, and the location of sampling ports within the sealing body 81.

FIG. 11 generally illustrates an embodiment of a packer assembly 100. The packer assembly 100 may be and/or may have the packer assembly 40, the packer assembly 50, the packer assembly 60, the packer assembly 80 and/or another type of packer assembly. The packer assembly 100 may have a collector 101, movable tubes 102, flowlines 103 and/or ports 104. The packer assembly 100 may have springs which may extend from one of the flowlines 103 to an adjacent one of the flowlines so that at least one of the springs may be connected to each of the flowlines 103. For each of the springs, one end may be connected to one of the flowlines, and the opposite end may be connected to an adjacent one of the flowlines.

In an embodiment, the collector 101 may have an inner sleeve fixedly connected to an outer sleeve. The collector 101 may deliver fluid collected from the surrounding formation to a flow system which transfers the fluid to a collection location. For example, one or more of the movable tubes 102 may transfer fluid from the flowlines 103 into the collector 101. For example, one or more of the movable tubes 102 may be connected to flowlines 103 extending to the ports 104 which are sampling ports, and one or more of the movable tubes 102 may be connected to flowlines 103 extending to the ports 104 which are guard ports.

The movable tubes 102 may be movably coupled to the collector 101 and the flowlines 103. For example, each of the movable tubes 102 may be coupled to the collector 101 and the flowline 103 for radial movement. Each of the movable tubes 102 may have any shape; in an embodiment, one or more of the movable tubes 102 may be generally S-shaped. The movable tubes 102 may move between a contracted configuration and an expanded configuration when the packer assembly 100 expands.

Figure 12:
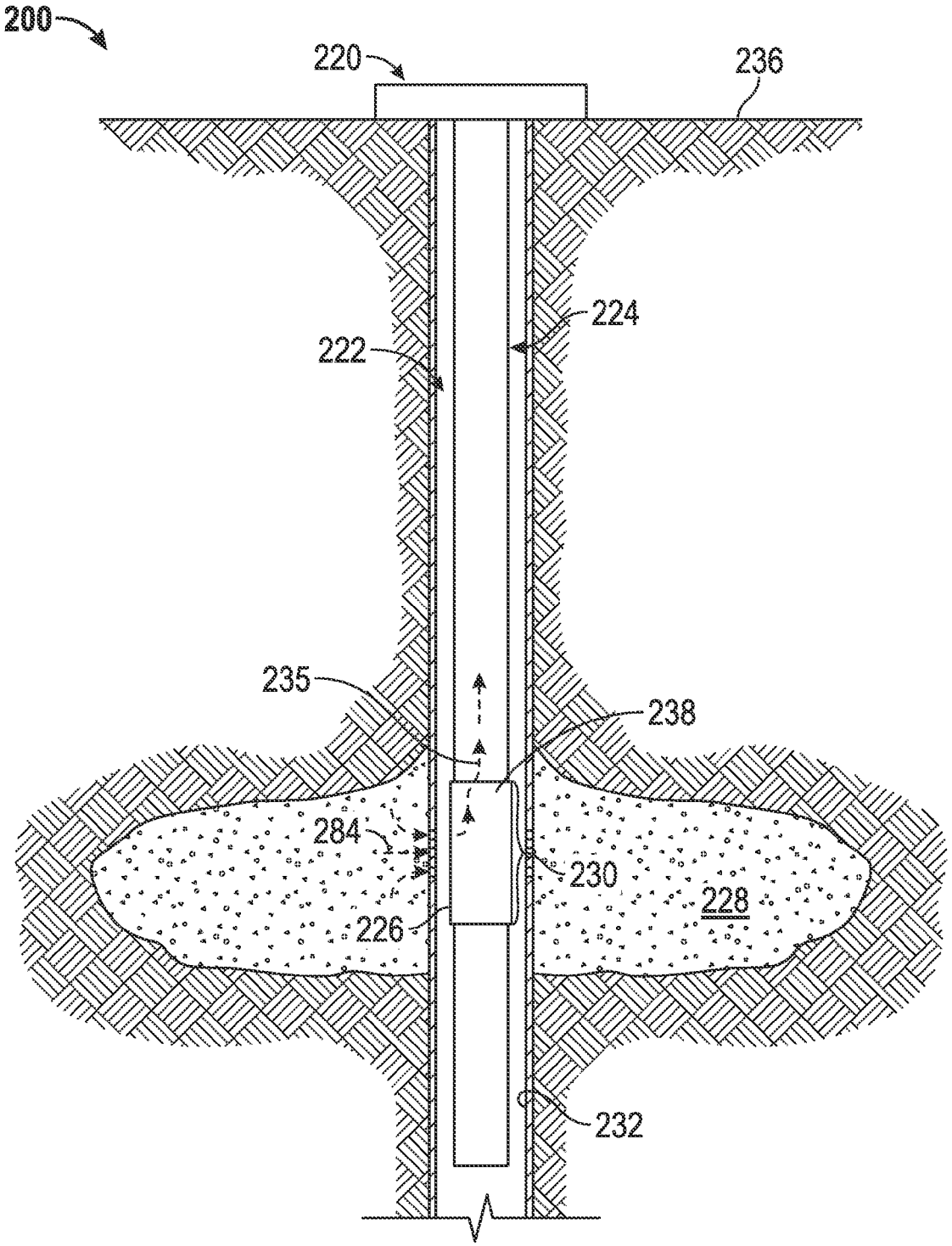
FIG. 12 illustrates an example of a wellbore system in which embodiments of a packer assembly may be employed in accordance with one or more aspects of the present disclosure.

FIG. 12 generally illustrates an embodiment of a well system 200. The well system 200 may have a conveyance 224 employed for delivery into a wellbore 222 of at least one packer assembly 226, such as the packer assembly 100, the packer assembly 40, the packer assembly 50, the packer assembly 60, the packer assembly 80 and/or another type of packer assembly. The conveyance 224 may be a wireline, a tubing string, and/or the like. The packer 226 may collect formation fluids from a surrounding formation 228.

The packer 226 may be positioned in the wellbore 222 and then may be expanded in a radially outward direction to seal across an expansion zone 230 with a surrounding wellbore wall 232, such as a surrounding casing or open wellbore wall. When the packer 226 is expanded to seal against the surrounding wellbore wall 232, formation fluids may be obtained by the packer 226 as indicated by arrows 234. The formation fluids obtained by the packer 226 may be directed to a flow line 235 and may be carried to a collection location, such as a location at a well site surface 236. A viscosity lowering system 238 may be incorporated into the packer 226 to enable selective lowering of the viscosity of a substance, such as oil, to be sampled through the packer 236.

The preceding description has been presented with reference to present embodiments. Persons skilled in the art and technology to which this disclosure pertains will appreciate that alterations and changes in the described structures and methods of operation can be practiced without meaningfully departing from the principle and scope of the disclosure. Accordingly, the foregoing description should not be read as pertaining only to the precise structures described and shown in the accompanying drawings, but rather should be read as consistent with and as support for the following claims, which are to have their fullest and fairest scope.

Moreover, means-plus-function clauses in the claims cover the structures described herein as performing the recited function and not only structural equivalents but also equivalent structures. Thus, a nail and a screw may not be structural equivalents because a nail employs a cylindrical surface to secure parts together and a screw employs a helical surface, but in the environment of fastening parts, a nail may be the equivalent structure to a screw. Applicant expressly intends to not invoke 35 U.S.C. §112, paragraph 6, for any of the limitations of the claims herein except for claims which explicitly use the words "means for" with a function.

We claim:

1. A packer assembly comprising:

an expandable inner packer member having an outer surface;

one or more sealing bodies wherein a first sealing body is positioned external to and non-integral with the expandable inner packer member, the first sealing body having an axial length and at least one sampling port providing fluid communication to the packer assembly wherein the first sealing body is movable from a retracted position radially outward to an expanded position as the expandable inner packer member moves radially outward, and wherein the first sealing body is not expandable; and a release agent disposed between the outer surface of the inner packer member and one or more of the sealing bodies, the release agent allowing the one or more of the sealing bodies to detach from the inner packer member.

2. The packer assembly of claim 1 wherein the expandable inner packer member comprises an inflatable bladder that radially expands upon receipt of a predetermined amount of fluid.

3. The packer assembly of claim 1 further comprising a second sealing body non-integral with the expandable inner packer member and the first sealing body.

4. The packer assembly of claim 3 wherein the first sealing body and the second sealing body are separated by a radial distance at the expanded position.

5. The packer assembly of claim 3 wherein the second sealing body has a sampling port located at a different axial position than the at least one sampling port of the first sealing body.

6. The packer assembly of claim 3 wherein the first sealing body is replaceable without replacement of the second sealing body.

7. The packer assembly of claim 1 wherein the first sealing body is made of an elastomeric material sealable against a wall of a wellbore or casing within a wellbore.

8. The packer assembly of claim 1 further comprising a flowline within the first sealing body and in fluid communication with the at least one sampling port such that at least a portion of formation fluid received from the sampling port flows into the flowline.

9. The packer assembly of claim 1 wherein the first sealing body has at least two sampling ports separated by an axial distance.

10. The packer assembly of claim 1 wherein the first sealing body is replaceable without replacement of the expandable inner packer member.

11. The packer assembly of claim 1 further comprising:

grooves in the outer surface of the expandable inner packer member, the sealing bodies being disposed in the grooves.

12. A method comprising:

deploying a packer assembly into a wellbore, the packer assembly having an inflatable packer member within a plurality of sealing bodies, at least one of the plurality of sealing bodies separable from the other sealing bodies, detached from the inflatable packer member and having a sampling port providing fluid communication between the wellbore and the packer assembly, and wherein each of the plurality of sealing bodies is not expandable and wherein the packer assembly further comprises a release agent disposed between an outer surface of the inflatable packer member and one or more of the sealing bodies, the release agent allowing the one or more of the sealing bodies to detach from the inflatable packer member;

inflating the inflatable packer member to move the plurality of sealing bodies against a wall of a wellbore to create an annular seal to substantially prevent fluid communication between an area above the packer assembly and an area below the packer assembly; and drawing formation fluid into the packer assembly via the sampling port.

13. The method of claim 12 wherein the inflating the inflatable packer member creates a gap between at least two of the plurality of sealing bodies and further wherein the inflating the inflatable packer member comprises at least partially filling the gap with the inflatable packer member.

14. The method of claim 12 further comprising transporting the formation fluid from the sampling port via a flowline within one of the plurality of sealing bodies.

15. The method of claim 14 wherein the flowline has an aperture providing fluid communication between the flowline and the sampling port.

16. The method of claim 12 wherein a first sealing body of the plurality of sealing bodies has a first sampling port and a second sampling port spaced axially from the first sampling port.

17. The method of claim 16 wherein a second sealing body of the plurality of sealing bodies has a sampling port that is radially unaligned with the first and the second sampling ports of the first sealing body.

18. The method of claim 17 further comprising drawing formation fluid into the sampling ports of the first sealing body and the sampling port of the second sealing body such that the sampling port of the second sealing body receives less mud contaminants than the sampling port of the first sealing body.

19. A packer assembly comprising:

an expandable inner packer member having an outer surface; and sealing bodies disposed on the outer surface of the expandable inner packer member, each of the sealing bodies having an axial length and at least one sampling port providing fluid communication to the packer assembly, and each of the sealing bodies separable from each other, and each of the sealing bodies is not expandable; and a release agent disposed between the outer surface of the inner packer member and one or more of the sealing bodies, the release agent allowing the one or more of the sealing bodies to detach from the inner packer member.

* * * * *